United States Patent [19]

Petry et al.

[11] Patent Number: 4,708,395

[45] Date of Patent: Nov. 24, 1987

[54] REMOTELY SENSING OF EXCAVATION CAVITY DURING MINING

[75] Inventors: Eston F. Petry, Barrackville; John B. Riester, Morgantown, both of W. Va.

[73] Assignee: Conoco Inc., Wilmington, Del.

[21] Appl. No.: 882,574

[22] Filed: Aug. 8, 1986

Related U.S. Application Data

[63] Continuation of Ser. No. 668,543, Nov. 5, 1984, abandoned.

[51] Int. Cl.[4] ..... E21C 35/24; E21C 37/12

[52] U.S. Cl. ..... 299/17; 299/1; 299/30

[58] Field of Search ..... 299/1, 17, 30, 16, 18

[56] References Cited

U.S. PATENT DOCUMENTS

| | | | |
|---|---|---|---|
| 3,555,349 | 1/1971 | Munz | 315/21 |
| 3,809,318 | 5/1974 | Yamamoto | 299/17 X |
| 3,978,444 | 8/1976 | Hitchcock | 340/3 |
| 4,023,861 | 5/1977 | Eickhoff | 299/1 |
| 4,033,626 | 7/1977 | Dinkelbach | 299/1 |
| 4,061,398 | 12/1977 | Parkes | 299/17 |
| 4,079,944 | 3/1978 | Grimley | 299/17 |
| 4,120,534 | 10/1978 | Addison | 299/1 |
| 4,142,763 | 3/1979 | Kumaki et al. | 299/1 |
| 4,167,290 | 9/1979 | Yamazaki et al. | 299/1 |
| 4,238,828 | 12/1980 | Hay | 364/559 |
| 4,261,617 | 4/1981 | Dröscher et al. | 299/1 |
| 4,281,876 | 8/1981 | Lansberry | 299/1 |
| 4,285,546 | 8/1981 | Etherington | 299/1 |
| 4,288,866 | 9/1981 | Sackman | 367/11 |
| 4,315,281 | 2/1982 | Fajans | 358/88 |
| 4,323,280 | 4/1982 | Lansberry | 299/1 |
| 4,330,154 | 5/1982 | Harris | 299/1 |
| 4,333,008 | 6/1982 | Misek | 250/225 |

*Primary Examiner*—Stephen J. Novosad
*Assistant Examiner*—David J. Bagnell
*Attorney, Agent, or Firm*—Cortlan R. Schupbach

[57] ABSTRACT

Method and apparatus for hydraulically mining a location using a hydraulic monitor which has horizontal and vertical positionable control apparatus. The hydraulic monitor is connected to a source of high pressure water. Distance and direction measuring equipment are mounted on the monitor and controlled in a manner to scan the location. The output from the distance and direction measuring equipment is inputted to a computer and a visual video display monitor. The computer converts the information from the distance and direction measuring equipment to a visual representation of the cavity being mined. The hydraulic monitor includes a means for diverting the high velocity jet during the distance measuring period so that the water pressure is not varied in the high pressure pipe and the mined material is continuously washed toward the collection apparatus during the measuring period. All hydraulic monitor functions are controlled from remote operator location.

14 Claims, 3 Drawing Figures

REMOTELY SENSING OF EXCAVATION CAVITY DURING MINING

RELATED APPLICATION

This application is a continuation of U.S. patent application Ser. No. 668,543, filed Nov. 5, 1984, now abandoned which is assigned to the same Assignee as this application.

BRIEF DESCRIPTION OF PRIOR ART

The prior art relating to this invention basically falls into three categories. The first category includes patents where laser beams are used to guide the device directionally. Patents such as U.S. Pat. Nos. 4,142,763; 4,238,828; 4,261,617; 4,023,861 and 4,033,626 fall into the first category, particularly where the directional control guides the digging equipment, such as tunnelling or mining. The second category of patents include visual equipment, such as television equipment. U.S. Pat. No. 4,281,876 falls into this category. Here a television monitor apparatus is mounted on a continuous mining machine. The mined out region is monitored so that the operator can control the mining machine in accordance with the picture displayed on the monitor. The third patents relate to apparatus for the actual cutting of material by the machine. U.S. Pat. No. 4,120,534 discloses a means for controlling the cutting head using a nuclear sensor to control the position of the mining apparatus in the coal seam. U.S. Pat. No. 3,978,444 and U.S. Pat. No. 4,288,866 are utilizing sonar as a means for determining the conditions or shape of the machine head of the sonar beam. An article entitled "*Radar Techniques for Monitoring Bunker Contents*" teaches the concept of using radar to locate the level of coal in underground bunkers.

None of the patents, however, are applicable to hydraulic mining where the cavity is continuously filled with particles broken loose by a high velocity jet stream.

BRIEF DESCRIPTION OF THE INVENTION

This invention discloses a method and apparatus for hydraulically mining a coal seam using a monitor for a hydraulic jet mounted thereon which is coupled to a source of high pressure water. The monitor includes means for remotely positioning the jet vertically and horizontally so that it can aim the jet at any location inside the region being mined. One of the basic problems in hydraulic mining is the high degree of danger to persons and damage to equipment in the mining location. High velocity water, debris, roof falls and other hazards are present as such a location. This invention discloses a means for mining such a location remotely while providing complete control of the monitor, the direction of control of the jet, and knowledge as to the removal of the material being mined during the mining operation.

The above is accomplished by mounting on the hydraulic monitor frame, distance measuring equipment such as a laser which is controlled to scan a certain region in the cavity being mined. The information from the scan is communicated to a computer which converts such information to a visual representation displayed on a video monitor where the operator controlling the hydraulic monitor can determine the actual location of the jet and consequently of the operation of the jet on the mining cavity. The apparatus includes means for diverting the jet to another hydraulic output during the actual scanning time. The diverted fluids provide two distinct advantages: first, the continual flow of water provides the needed fluids for the mining sluices which carry the mined material to the sumps or other disposal regions in the mine and second, the diversion prevents water hammer in the high pressure pipeline during the scanning operation thus protecting the pipeline and the personnel from pipe fractures caused by the water hammer. The invention will also increase the recovery rate from a mine by better controlling the removal of material thus preventing unplanned roof falls or mine roof cave-ins.

DETAILED DESCRIPTION OF THE INVENTION

Figure 1:
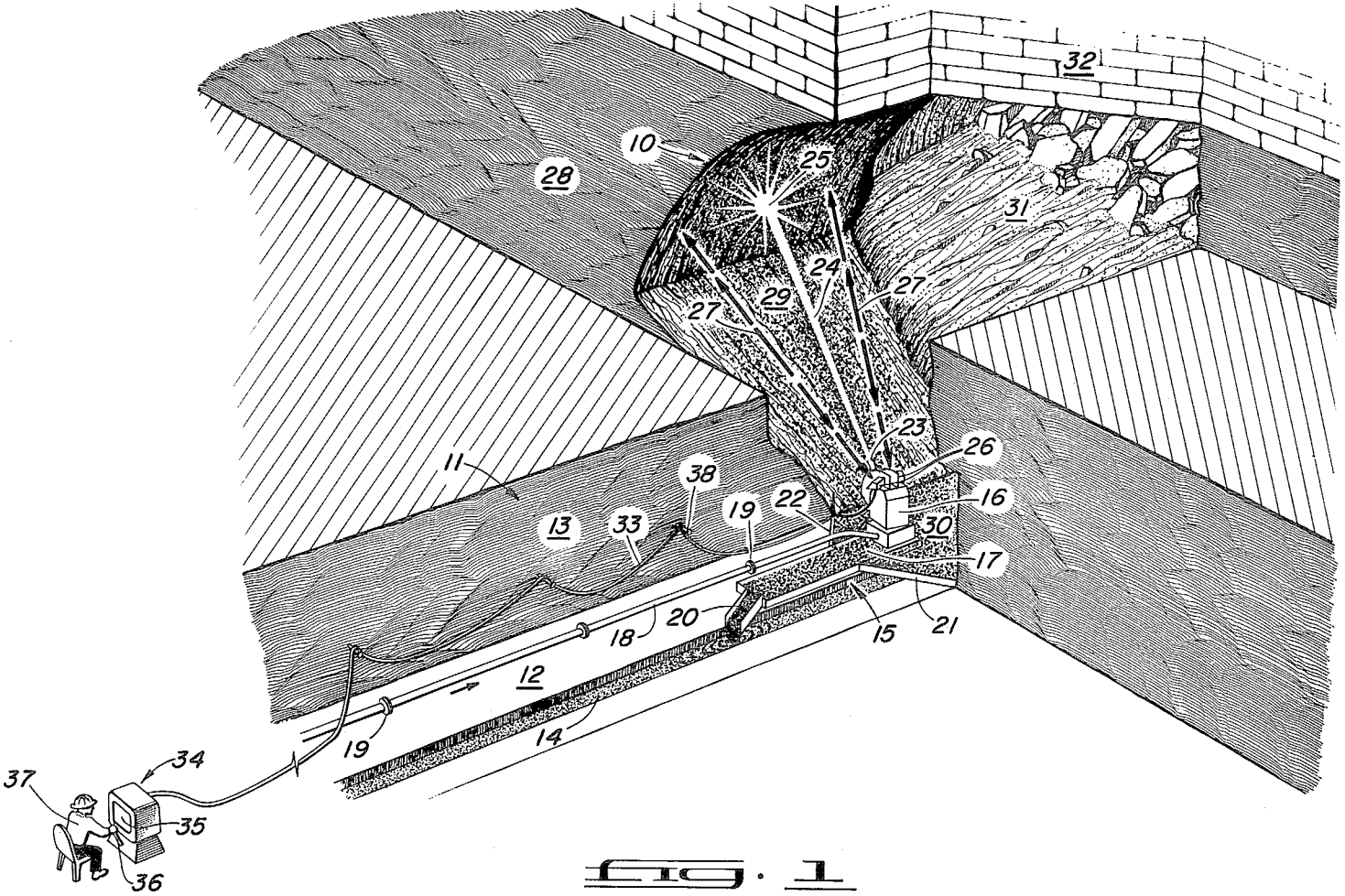
FIG. 1 is a cutaway portion of a mine being mined hydraulically illustrating the operation of the invention.

Referring to FIG. 1, a general mining layout is illustrated which essentially comprises a cavity referred to by arrow 10 which is accessed by a tunnel referred to by arrow 11. Tunnel 11 contains a floor 12, side walls 13, and roof, not illustrated. Tunnel 11 generally includes a sluice 14 for carrying away the mining water and material being removed by high velocity jet. A monitor apparatus referred to by arrow 15 generally includes a monitor 16 connected to a crusher and conveyer apparatus 17. A high pressure line 18 is assembled in several sections by connecting joints 19. As the monitor removes the material from cavity 10, sections of high velocity high pressure line 18 are removed to accommodate the necessary movement of the monitor apparatus 15. Attached to the end of crusher and conveyer apparatus 17 is a trough 20 which is positioned over sluice 14. Sideboards 21 and 22 are mounted between side walls 13 and monitor apparatus 15 in order to direct the mined material into the crusher and conveyer apparatus 17. Monitor 16 has a high velocity nozzle 23 mounted to direct a water jet 24 against cavity 10 at a location 25, for example. Monitor 16 also includes distance measuring equipment 26 which transmits and receives a signal as indicated by arrow 27. Such equipment and its use will be better described when reference is made to FIG. 2. Jet 24 strikes cavity 10 at location 25 dislodging material from a seam 28, which material then falls along slope 29 to the bottom 30 of cavity 10. As the material is continually mined from a region, cavity 10 will collapse in the form of gobb 31 which represents material 32 above cavity 10 which no longer can be supported when seams 28 being mined is completely removed from under it. The controls for monitor 15 are connected through a cable 33 to remote control apparatus 34 which includes a visual screen 35 and a manual control apparatus 36 along with a computer, not shown, in FIG. 1. An operator 37 viewing screen 35 can remotely control monitor 15 through control 36. A cable 33 may be attached at periodic intervals to side wall 13 by pins 38. Any satisfactory means for supporting the cable can be used in order to prevent it from being damaged during the operation.

Figure 2:
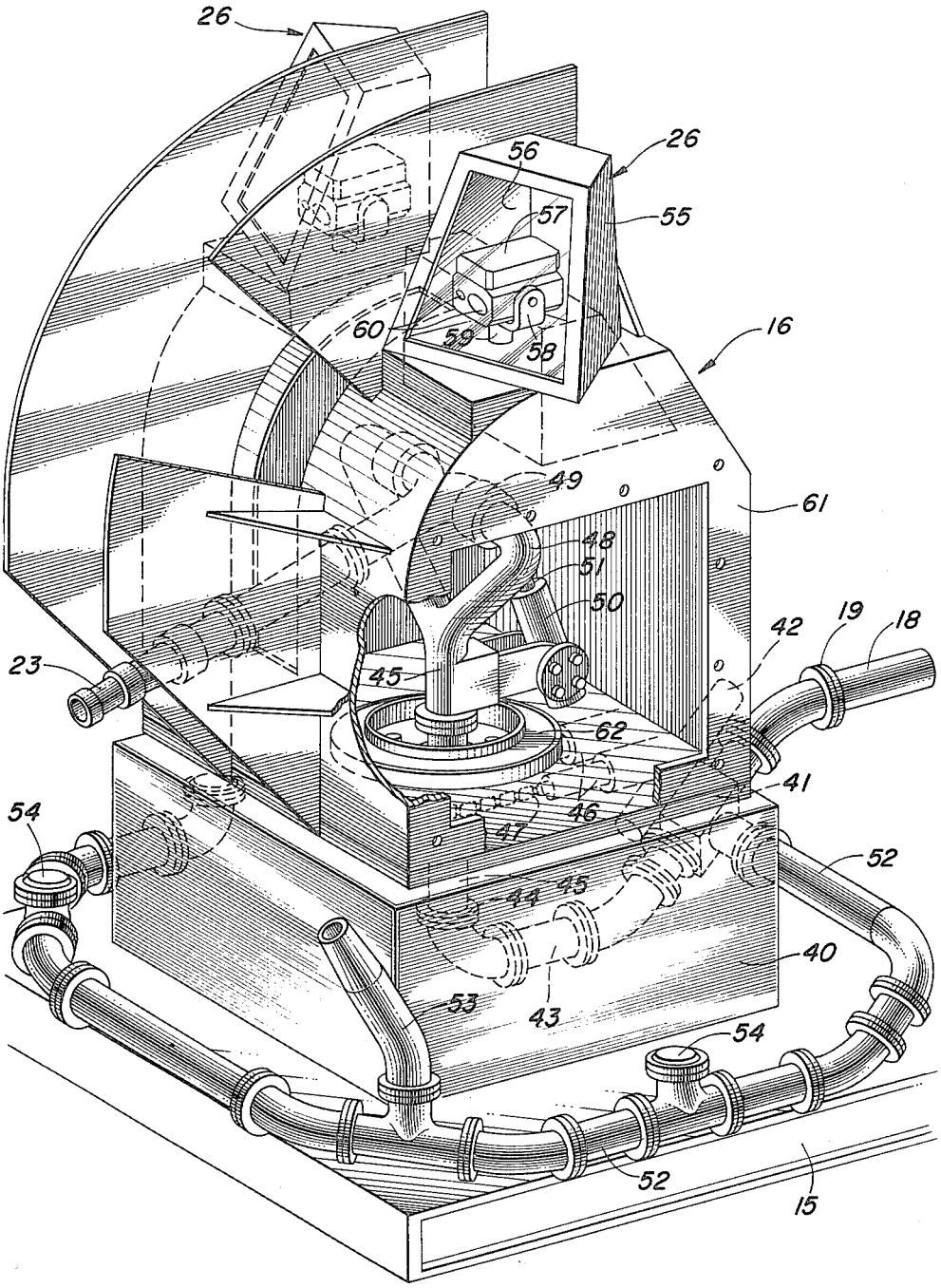
FIG. 2 is an orthogonal view of the monitor used for carrying out the invention with a portion of the hydraulic monitor cutaway to illustrate its internal structure.

The actual monitor 16 used to carry out the invention is disclosed in FIG. 2. Monitor 16 includes a base 40 attached to monitor apparatus 15 in any manner such as bolts. High pressure line 18 is coupled through joint 19 to a valve 41 which includes an electrical control 42. Pipe 18 continues inside base 40 through pipes 43 to a vertical rotatable joint 44 which in turn is coupled to a vertical pipe 45. Joint 44 permits pipe 43 to be rigid while pipe 44 can be axially rotated. Pipe 45 is rotated by means of hydraulic pistons 46 and chains 47 which are around a sprocket, better illustrated in FIG. 3. Pipe 45 is coupled to a "Y" 48 which in turn is coupled to a horizontally rotatable joint 49. Joint 49 is then coupled to high velocity nozzle 23. High velocity jet 23 is positioned by means of a hydraulic cylinder 50 which is coupled through a shaft 51 to high velocity nozzle 23. This also is better illustrated in FIG. 3.

The features above described are all common to most hydraulic monitor apparatus. In addition to the common features, this invention provides a pipe 52 which is coupled to a diverter nozzle 53. Additional openings 54, which are illustrated capped, provide alternate mounting locations for nozzle 53. Such alternate mounting locations are necessary in case the nozzle 53 becomes damaged, broken, or the location for the particular mining region is not satisfactory. Mounted on monitor 16 are the distance measuring equipment 26. Each distance measuring equipment includes a case 55 which is preferably water proof with a cover 56 which is transparent to the radiation from apparatus 57 which transmits the actual beam for determining the distance between the monitor and the coal or other material being removed. Apparatus 57 is mounted on a yoke 58 and a shaft 59 for providing both vertical and horizontal movement of apparatus 57. Apparatus 57 has an output and collection region 60 for transmitting and receiving the distance measuring beam. Since both the distance measuring apparatus are the same, only one will be described.

Figure 3:
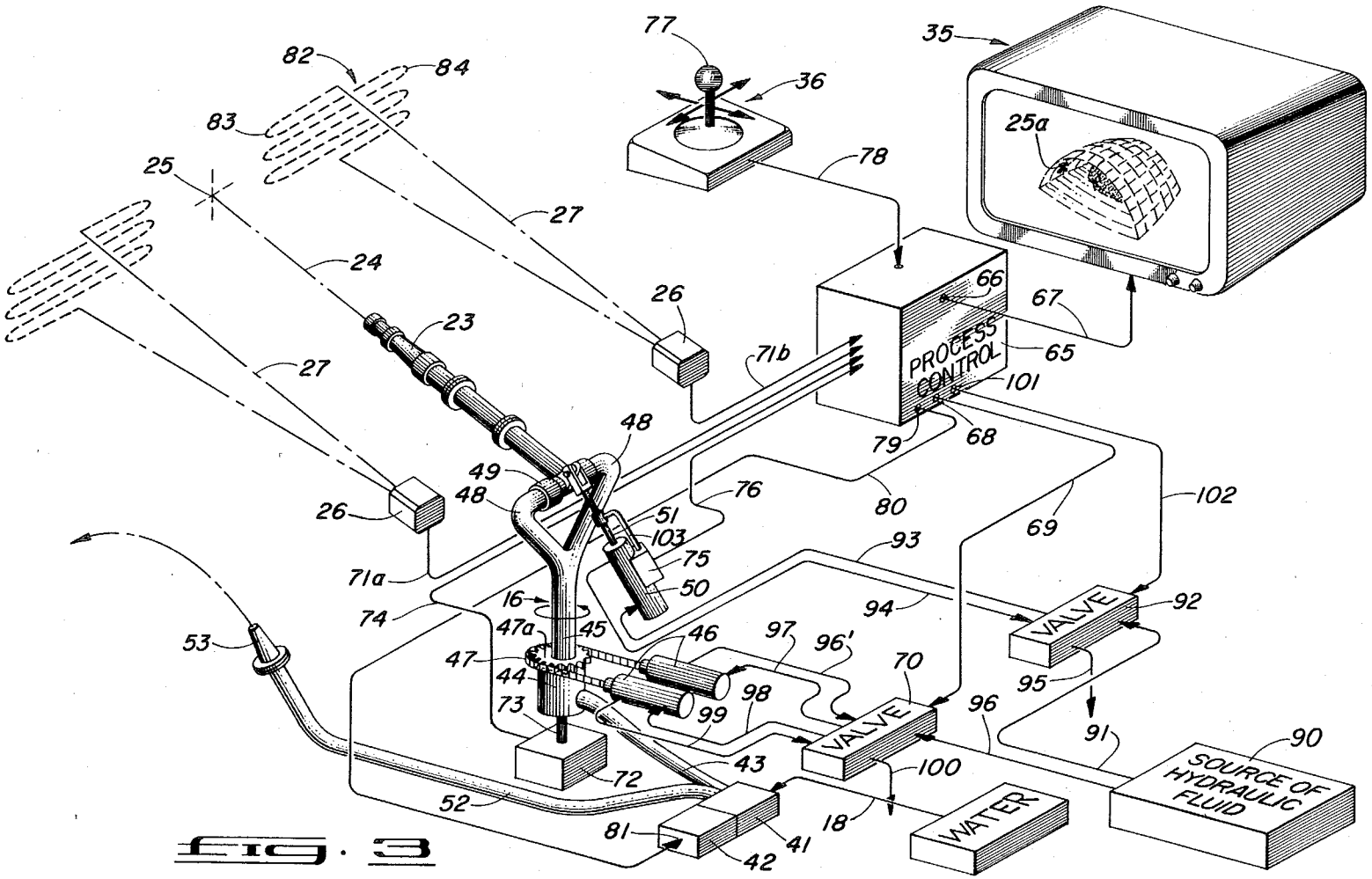
FIG. 3 is a schematic drawing of the circuitry involved in the scanning process and display of the invention as well as the control system necessary to control the monitor.

The actual mining operation and the equipment are best described by referring not only to FIGS. 1 and 2 but also FIG. 3. Referring in particular to FIG. 3, a process controller which may be a microcomputer 65 has an output 66 coupled through a wire 67 to video monitor 35. An output 68 is coupled through wire 69 to valve 70 which controls the horizontal positioning of monitor 16. An output 101 is coupled through wire 102 to valve 92 which controls the vertical positioning of the high velocity nozzle 23. The output from each of the distance measuring equipment 26 is coupled through wires 71*a* and 71*b* to process controller 65. In order to determine the horizontal position of high velocity nozzle 23, an electrical position feedback apparatus 72 is coupled through a shaft 73 to pipe 45. The output from feedback apparatus 72 is coupled through a wire 74 to the input of process controller 65. A second electrical feedback apparatus 75 determines the vertical position of high velocity nozzle 23. Feedback apparatus 75 is coupled through a wire 76 to process controller 65. A manual control 36, which may include a joy stick 77, is coupled through a wire 78 to the process controller 65. Electrical control valve 42 is controlled through outlet 79 from process controller 65 which is connected to a wire 80 to an input 81 of valve 42. Distance measuring equipment 26, as previously discussed, generates a beam 27. Beam 27 scans the wall through a pattern illustrated by arrow 82 which passes from one extreme 83 to the other extreme 84.

The hydraulic operation of the various elements is powered through a source of hydraulic fluid 90 which has the coupling pipe 91 connected to a hydraulic valve 92. Valve 92 provides hydraulic fluid under pressure either through line 93 or 94 to hydraulic cylinder 50. If one line, for example 93, is pressured, the remaining line 94 will be providing the return to valve 92. Hydraulic valve 92 has its return to sump (not shown) through a pipe 95. Hydraulic fluid is also provided through either the same line or another line 96 to valve 70. Hydraulic lines 96 and 97 are connected to one of the cylinders 46, while the second pair of lines 98 and 99 is coupled to the remaining hydraulic cylinder 46. A return line 100 from valve 70 is connected to a sump (not shown). An output 101 from process controller 65 is coupled to a wire 102 to valve 92.

OPERATION

Referring to all of the figures but in particular to FIG. 3, the operation of the monitor and control equipment is specifically described.

In order to initiate operation of the system the cavity in which the system is mounted must be visible on the visual display apparatus 35. In order to perform this step, the monitor apparatus 15 is moved into the region where material is to be hydraulically mined. The hydraulic monitor is then connected to the high pressure line 18, and cable 33 is connected between monitor 16 and the remote control system 34. The cavity must then be defined prior to the mining operation commencing. Since the entire cavity must be scanned in order to present a picture on display equipment 35, the scanning is preferably begun at the start of the cavity. Distance measuring equipment 26, which may be lasers, are then turned on and the scanning process begun. One method for scanning a substantial portion of the cavity is to move the distance measuring apparatus 57 about yoke 58 for vertical movement and about shaft 59 for horizontal movement. Since there are two separate distance measuring apparatus, the portion of the cavity available to both pieces of scanning equipment 26 is inputted through wires 71*a* and 71*b* to process controller 65. The information is then stored in the process controller or displayed immediately on display apparatus 35. In order to map the entire cavity, the monitor is rotated about its vertical axis by operating handle 77 of joy stick 36 transmitting a corresponding signal down wire 78 to process controller 65. Controller 65 will then communicate a signal to valve 70 which properly pressurizes cylinders 46 through pipes 96, 97, 98 and 99. The hydraulic fluid from cylinders 46 will pass through valve 70 and pipe 100 and then the sump (not shown). Cylinders 46 will cause chain 47 to rotate sprocket 47*a* which is attached to pipe 45. Since housing 61 is attached through mount 62 to pipe 45, rotation of sprocket 47*a* will cause rotation of housing 61. Distance measuring equipment 26 is attached to housing 61. Any rotation of housing 61 will cause a corresonding rotation in equipment 26, therefore, to map and display the entire cavity, housing 61 is rotated with the actual arcuate position communicated to process controller 65 from feedback apparatus 72. The scanning process is repeated or continued as the case may be with the monitor housing 61 rotating on its axis until the entire cavity is plotted on the display apparatus. Once the map of the cavity is complete, then hydraulic source 90 will provide power for moving cylinders 46 in a manner to pull chain 47 so that the monitor will again be properly positioned about its vertical axis.

It is obvious, of course, that to do the initial cavity survey, the distance measuring equipment 26 on monitor apparatus 16 does not need to be used. A separate survey apparatus can be used as long as it is properly positioned in the cavity region and the survey data transmitted to process controller means 65 and the data stored.

Referring to FIG. 1 the initial mining operation is begun by sliding or positioning the hydraulic monitor apparatus 15 in the location determined for proper mining of the cavity. The distance measuring equipment 26 is energized and the proper position of the monitor horizontal and vertical axis is communicated through feedbck apparatus 72 and 75 to corresponding wires 74 and 76 to process controller 65. This information will then be processed and positions a cursor 25*a* on the display in display apparatus 35. The cursor will give the operator 37 an indication of where the hydraulic monitor jet will strike when it is turned on. The operator then positions the hydraulic jet location by movement of joy stick 77 watching cursor 25*a* until it is positioned where the mining is to begin. Once the monitor is in proper position as indicated by cursor 25*a*, then the signal from the process controller initiated by operator 37 is transmitted to the control valve 41 through wire 80 so that water can pass through pipe 18 and pipe 43 to rotatable joint 44. The water then passes up pipe 45 through y-arms 48 to high velocity jet 23. The high velocity water jet 24 will then leave monitor 16, striking the cavity at location 25, causing material to be removed and washed down slope 29 where it is collected by sideboards 21 and 22 so that it is guided into the crusher conveyers of monitor apparatus 15. It will then pass through trough 20 and into sluice 14 where it is removed from the mine face.

It should be noted that the material being removed is transported with the fluid from high velocity jet 24. During the mining operation a large quantity of atomized water particles, coal pieces or other material is being blasted from the cavity wall. The material and water will tend to fill the cavity so that it will be difficult for the distance measuring equipment 26 to pass through the debris and water. If this is the case, the water jet or stream 24 must be shutdown during the measurement period; however, if the water stream is shutoff during the measurement period, then no water is being supplied to wash the material from slope 29 through the monitor apparatus 15, trough 20 and sluice 14. Thus a novel arrangement has been devised whereby valve 41, through its electrical control portion 42, can switch to a secondary jet or diverter nozzle 53. This jet will handle the same quantity of water as high velocity jet 24 but will not have a high velocity so that the cavity will remain free of water particles and debris. The diverter nozzle also provides means for shutting down the high velocity water jet 24 without creating water hammer in pipe 18. Such water hammer could damage or crack the pipe posing a hazard to personnel in the area of the pipe, particularly since the water in pipe 18 is under extremely high pressure.

Once the water has been diverted to nozzle 53, a survey is retaken of the area mined and such survey results are communicated through wires 71a and 71b to process controller 65. Once the information has been given to process controller 65, the display on monitor 35 is readjusted to convey the changed status of mine cavity 10. Knowing the exact location of the mining operation and the conditions of the cavity during the mining operation, potential roof fall situations and mistakes in mining locations can be corrected.

With a high degree of control in the mining of the cavity and exact knowledge of the condition of the cavity, a much higher percentage of material, such as coal, can be removed, thereby substantially increasing the output of the mine per money invested. Once the cavity is in danger of collapsing into a gobb 31, the monitor can be moved back and mining recommenced. So long as the process controller can account for the new location of the monitor accordingly, then a new survey of the cavity should not be necessary.

CONCLUSIONS

A unique system of controlling the hydraulic mining of a cavity has been disclosed. It provides for a system of using a laser, survey equipment, and communicating the survey to a process controller where the information can be displayed on a visual monitor. The visual monitor provides actual information on the cavity during the operation so that a miner in a remote location can control the monitor position to control the removal of the material with a high degree of certainty, thereby substantially increasing the material removed from the mine before the monitor must be retreated to a new location.

It is obvious that the survey equipment could be mounted on another piece of apparatus separate from the monitor; however, in the preferred embodiment, the survey equipment is mounted directly on the monitor. If the debris and water particles are such that the equipment cannot penetrate sufficiently to get valid dimensions of the cavity, then a diverter jet is provided which permits the high velocity jet to be diverted to a low velocity jet, thereby eliminating the debris and water vapor in the cavity to a large extent. The diverter jet also provides a means for moving the water to a low velocity jet without creating water hammer in the pipe supplying the high velocity jet. The above system for hydraulically mining a cavity provides a high degree of safety for the operator and a high degree of knowledge as to the cavity during the actual mining operation.

It is obvious that the mining operation can be completely controlled by computer, if desired, without the input of any information by a mining personnel through the use of a joy stick 36 as shown in FIG. 1, since the size of the cavity, the location of the mining machine and the operation of the jet are well known and are imputted into the computer. It is further obvious that the computer could then control the mining operation in its entirety. However, the preferred embodiment of the invention provides the miner with complete control of the operation of the mining process through the use of a visual monitor 35 as illustrated in FIG. 1.

It is obvious that changes can be made in the application and still be within the spirit and scope of the invention as disclosed in the specification and appended claims.

What is claimed is:

1. Apparatus for hydraulically mining a location, said apparatus including a hydraulic monitor means having horizontal and vertical positionable control means, a source of high pressure water, and means for coupling said source of water to said monitor means, an improved apparatus comprising:

a. distance measuring means having a beam means and a signal output;
b. process control means having a signal input means, a display output means and signal output means;
c. means coupling said signal output of said distance measuring means to said signal input means of said process control means;
d. display means having a signal input and a visual display;
e. means for coupling said display output means of said process control means to said signal input of said display means;
f. control means having an output coupled to said signal input means of said process control means; and
g. monitor control means having a signal input and an output coupled to said horizontal and vertical positionable control means, with said signal input of said monitor control means coupled to said signal output means of said process control means whereby said beam means from said distance measuring means determines the contour of said mining location, said contour being displayed in said visual display of said display means and wherein operation of said control means cause said process control means to develop an output at said signal output means to said horizontal and vertical positionable control means to position said hydraulic monitor means.

2. Apparatus as described in claim 1 wherein said distance measuring means comprises a laser generating said beam means which impinges on said reflects from said location to said distance measuring apparatus generating a corresponding electrical signal at its signal output.

3. Apparatus as set out in claim 2 wherein said distance measuring means is swept both vertically and horizontally to develop a series of points which can be visually displayed on said display means as a three-dimensional representation of said location being mined.

4. Apparatus as described in claim 1 wherein said means for coupling said source of high pressure water to said hydraulic monitor means includes a control valve means having a signal control input and first and second fluid outlets, fluid diverter means, means for coupling said diverter means to said first outlet of said control valve means, means for coupling said hydraulic monitor means to said second fluid outlet and means for coupling said signal control input of said control valve means to said signal output means of said process control means whereby said source of high pressure water to said hydraulic monitor means can be diverted during the operation of said distance measuring means from said hydraulic monitor means to said diverter means.

5. A method for the remote control of a location being mined hydraulically having a floor and walls comprising:

a. directing a high velocity stream of water against the location to hydraulically mine material at said location, during a predetermined interval of time;
b. diverting said high velocity stream of water to another position at said remote location;
c. measuring the distance form a known position to a plurality of points on said walls;
d. transmitting said measured distances to a computer means;
e. displaying said measured distances as calculated by said computer means to generate a representation of said location; and
f. continuing said sequence of hydraulically mining and diverting said water to generate an updated representation of said location.

6. The method as described in claim 5 wherein the direction of said high velocity stream of water is controlled by said computer.

7. The method as described in claim 6 wherein said computer is controlled by manually inserting coordinates into said computer in correspondence to a desired change as determined by said display.

8. Method as described in claims 5, 6, or 7 including scanning said location while measuring said distance, thereby generating a complete representation of said location.

9. Method of hydraulically mining a surface of a mining location comprising:

a. determining the dimensions of said surface of said mining location from a fixed point at said location;
b. constructing at a second location remote from said mining location a visual representation of said surface from the determined dimensions of said mining location with respect to said fixed point;
c. jetting water under high pressure against a selected area on said surface of said mining location;
d. determining changes in said dimensions of said selected area of said surface of said mining location;
e. reconstructing at said second location a new visual representation of said surface from the determined changes of said location during the jetting of said water; and
f. redirecting said jetted water under high pressure utilizing data from said reconstruced visual representation.

10. The method as described in claim 9 wherein said dimensions are determined by scanning, using distance measuring equipment, said area.

11. The method as described in claim 9 or 10 wherein said visual representation is contructed at a second location remote from said mining location.

12. The method as described in claim 9 or 10 wherein said jetting of said water is interrupted during the period of time said dimension is determined.

13. The method as described in claim 9 or 10 wherein said water is diverted during the period of time said dimensions are determined.

14. An apparatus for hydraulic mining of materials, said apparatus including a frame having a nozzle means having vertical and horizontal positioning means mounted on said frame, and a first input means coupled to said nozzle means, an improvement comprising:

a. distance measuring means mounted on said frame and oriented to measure in the direction of said nozzle;
b. means for operating said distance measuring means;
c. diverter nozzle means mounted on said frame and oriented along the direction of said nozzle means;
d. second input means coupled to said diverter nozzle means; and
e. means for coupling said first input means to a source of high pressure fluid while said distance measuring means is not in operation and for coupling said second input means to said source of high pressure fluid when said distance measuring means is in operation.

* * * * *